US005125814A

United States Patent [19]

Lester

[11] Patent Number: 5,125,814

[45] Date of Patent: Jun. 30, 1992

[54] BRICK LAYING TOOLS

[76] Inventor: Borislav Lester, 20 Saturn Terrace, Doncaster, East, Victoria, 3109, Australia

[21] Appl. No.: 596,018

[22] Filed: Oct. 11, 1990

Related U.S. Application Data

[63] Continuation-in-part of PCT/AU88/00124, Apr. 29, 1988.

[51] Int. Cl.[5] ..... B05C 5/02; E04G 21/20

[52] U.S. Cl. ..... 425/62; 222/611.1; 222/611.2; 401/193; 425/87; 425/458

[58] Field of Search ..... 425/62, 87, 458; 222/611.1, 611.2; 401/193

[56] References Cited

U.S. PATENT DOCUMENTS

| | | | |
|---|---|---|---|
| 1,187,281 | 6/1916 | Doll | 425/87 |
| 1,780,902 | 11/1930 | Ainslie | 425/87 |
| 1,833,582 | 11/1931 | Kavanagh | 222/611.2 |
| 2,674,116 | 4/1954 | Erp | 425/87 |
| 2,683,981 | 7/1954 | Richey | 222/611.2 |
| 3,146,509 | 9/1964 | Negwer | 425/458 |
| 3,148,432 | 9/1964 | Garnett | 425/62 |
| 3,163,881 | 1/1965 | Apicella | 425/87 |
| 3,545,159 | 12/1970 | Brewer | 425/87 |
| 3,791,559 | 2/1974 | Foye | 222/611.2 |
| 3,826,410 | 7/1974 | Meyer | 222/611.2 |
| 4,294,383 | 10/1981 | Hession | 222/611.1 |
| 4,352,445 | 10/1982 | Cusumano et al. | 222/611.2 |
| 4,697,951 | 10/1987 | Allen | 222/611.1 |

*Primary Examiner*—Willard Hoag

*Attorney, Agent, or Firm*—Marion P. Lelong

[57] ABSTRACT

A mortar course tool has a tray with a sliding plate which slides under a rectangular open frame surrounding the plate to close a mortar wafer dropping gap formed by the frame while the mortar is being carried to a brick wall; the sliding plate slides away from the frame to open the gap dropping a wafer of mortar of brick top area and mortar course thickness. Runners behind and connected to the frame telescope into sleeves behind and connected to the plate in an arrangement clear of mortar to enable frame and plate to be moved towards and away from each other by means of a cross bar pull handle on each. The perpend gap filling tool is formed as a hopper designed to straddle a perpend gap between two bricks laid on a wall and with a bottom sloping towards a slot which a user places over the perpend gap and pushes mortar into the perpend gap using a spatula; the perpend tool also has two legs projecting downwards in alignment with the slot and the perpend gap to retain mortar and give a finished perpend; two bottom side lugs are provided to locate the perpend tool on laid bricks.

10 Claims, 2 Drawing Sheets

BRICK LAYING TOOLS

RELATED APPLICATION

This is a continuation-in-part of co-pending International Application Number PCT/AU88/00124, filed Apr. 29, 1988.

This invention relates to brick laying tools which will enable unskilled people to lay bricks upon a course to a professional standard of appearance and structural requirements.

BACKGROUND OF THE INVENTION

In conventional brick laying practice, the mortar is manually spread on top of the existing course with a hand-held trowell. A hand-held brick is buttered on one end and placed on the top line of a just-thrown mortar. The brick is then aligned by bumping the brick down into the mortar. The mortar is then cleaned off and the joints finished off as required. This method suffers from the disadvantage that mortar is handled twice, once from a barrow to a mortar board and then from the mortar board to a hand-deposited mortar line. The physical effort required to hold the loaded mortar board with one hand whilst depositing mortar with the other is considerable. Extrusion of excess mortar causes high loss and tends to dirty exposed surfaces of bricks and requires recycling. Furthermore, mortar has to be buttered on an end of each brick before laying. This situation demands that the bricks are in close proximity to mortar storage for application of mortar and mortared bricks are then carried to the mortar line for laying.

Prior devices and equipment for laying mortar on brick wall courses have been proposed. One such device is described in United Kingdom patent No. 693,274 of Clark which discloses a box-like mortar spreader with a carriage frame on wheels running on guide rails -the slidable floor is suspended from the frame and attached to and projecting down from the floor is an inclined screeder which pushes mortar along the wall to form a mortar layer. Special seals are required because of spillage and repointing is required. U.S. Pat. No. 1,594,775 of Greslen is a mortar spreader for concrete block walls having a large central cavity which the device masks by an inverted V-wall in a large hopper with two mortar-cutting slides to obtain correct thickness of mortar for a course. The sliding mechanisms are submerged in mortar causing sticking so scraping fingers are used. Another mortar course spreader for use with blocks with central cavities is that of U.S. Pat. No. 1,789,902 of Ainslie wherein a large hopper has a bottom opening feeding a spreading edge and runs on rollers and a central baffle plate covers central brick cavities. A trowel is used to level laid mortar and to fill end joints. U.K. patent 1,251,820 of Eurofina et al discloses a mortar sliding hopper/spreader for interlocking cavity bricks of H-section, the hopper is filled with mortar while on the wall and has an inverted, cavity-covering V-shaped baffle. A separate compressing/aligning tool is used. German patent 2,719,777 of Best discloses a sliding hopper with a manually-operated, rotor with fingers to break up and dispense mortar onto the top of a brick line. Mortar is not prevented from dropping into brick cavities. U.K. patent 347,093 of Kavanagh discloses a mortar spreader with heavyweight wheeled hopper movable between two heavy guiding straight edge flange plates pre-fixed to the wall by plugs inserted into courses. A screed gauge is used to scrape the laid mortar to the required level. Another mortar course hopper spreader is disclosed in U.K. patent 602,084 of Laing, a hopper has a level bottom with a transverse slot, runners lift the hopper above brick level and are skirted to lap brickwork sides; mortar is not laid for whole brick width; a central inverted V-shaped baffle is used to prevent mortar falling down a central cavity, no perpend tool is used. A mechanical, heavy-duty mortar spreader is disclosed in British patent 973,446 of Sapat; the hopper bottom opening has three adjustable plates to govern spreading and is supported on a separate carriage with rollers for suspension on a rail; cams and a hand turned crank jolt mortar from the hopper—jolting is an important feature of Sapat. A box-like mortar spreader is disclosed in U.S. Pat. No. 3,764,22 of Orthman wherein the rectangular box has front and rear gates for back and front wall bottom openings, mortar scrapers are used and the bottom of the box is a removable tray and a spring-loaded gate covers the front wall opening when the tray is removed. A hand operated agitator handle is used to cover bricks and a perpend crack with mortar. A brick cavity is masked with a plate.

SUMMARY OF THE INVENTION

It is an object of this invention to provide a tool kit consisting of a brick wall, mortar-carrying and mortar course laying tool and a mortar carrying tool for use in filling with mortar a perpend gap between laid bricks.

Another object of this invention is to provide a brick wall mortar course tool which will lay a formed wafer of mortar of brick top surface dimensions on a brick wall mortar course without wastage.

A further object of this invention is to provide a tool which can be used with a spatula to fill a brick wall course perpend gap with mortar without wastage or smearing of mortar and to achieve a finished perpend.

In accordance with these objects and the principles of this invention there is provided a mortar laying tool kit of two main components, namely a mortar course tool and a perpend filling tool, both tools can carry an amount of mortar from a source to a brick wall line. The mortar course tool is used to lay a brick-area sized wafer of mortar on a brick course and has a rectangular tray frame portion formed by side walls and end walls surrounding a bottom opening of dimensions substantially equal to the area and thickness of mortar of a brick course, the tray portion is openable and closable by a flat bottom plate laterally slidable underneath the opening and integrally connected to two slide sleeves which are isolated from the mortar. The sleeves are connected to a movement stop plate and to each other by an inner cross-bar pull handle and are mounted upon runners the outer end of which are connected by an outer cross bar pull handle, the flat bottom plate is moved into a fully open position to drop a formed wafer of mortar onto a brick by pulling by hand the inner cross bar pull handle outwards or both handles towards each other and the plate is moved into a fully closed mortar-loading position by moving the inner cross-bar handle inwards or both handles away from each other. No levelling of the dropped mortar wafer is required and there is no waste. The perpend filling tool has an open-top hopper with four side walls and a floor sloping towards a transverse bottom slot designed to be placed over a mortar perpend gap between bricks on a brick wall after a horizontal mortar course has been laid by the mortar course tool; the mortar is rammed through the hopper slot into a perpend gap by a spatula while the perpend tool is in place on a brick wall line. An additional feature of the perpend tool is two perpend-shaped, mortar-retaining legs which project down from the bottom corners of the hopper adjacent the slot ends to mould the perpend and prevent spillage or smearing. Additional features are a separate fixed, tool-positioning handle and two positioning lugs are attached along the outer edge of the mortar course tool.

The novel arrangement of features which are considered to characterize the invention are set forth in particular in the appended claims.

Other features, uses and advantages of the invention will become apparent from a reading of the following description of the embodiments thereof presented in the drawings.

BRIEF DESCRIPTION OF THE DRAWINGS

A non-limitative example of preferred embodiments of the brick wall mortar laying kit of tools according to the invention will be described in greater detail by reference to the accompanying drawings in which like reference numbers denote like parts and in which.

DESCRIPTION OF THE ILLUSTRATED EMBODIMENTS

Figure 1:
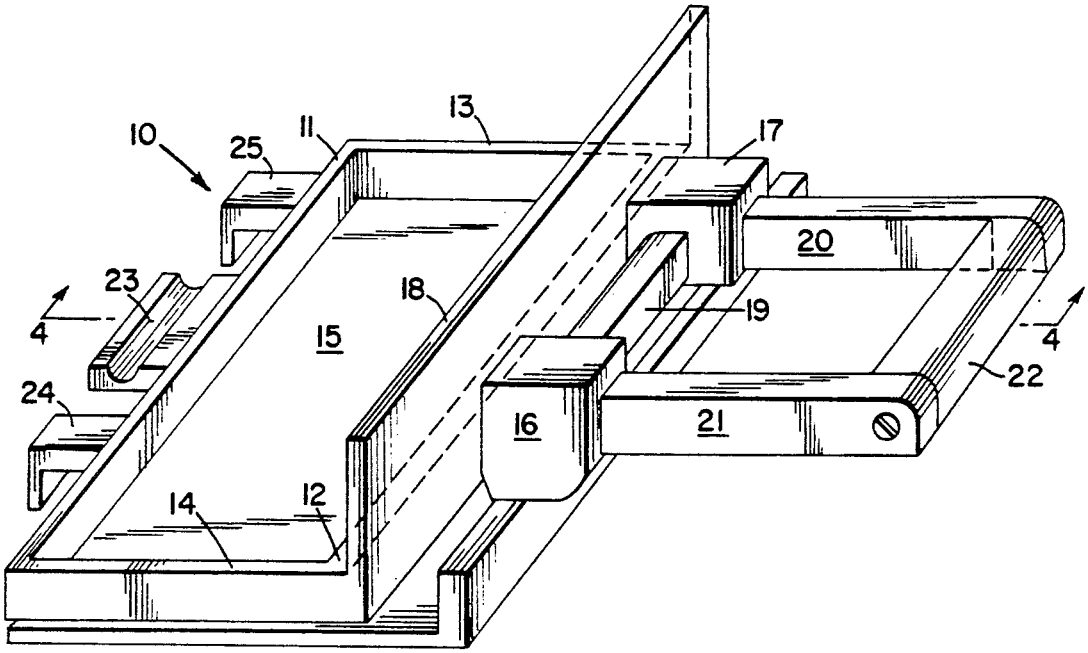
FIG. 1 is a perspective view of one embodiment of a mortar course, mortar carrying and laying tool according to the invention.

Reference is now made to the drawings in which FIG. 1 shows in a closed position, a mortar course tool 10 for carrying and laying a definitive quantity of mortar in the form of a wafer upon a brick course. The tool 10 comprises a body with a mainly rectangular-shaped tray portion with shallow walls defining and surrounding an open bottom of lateral dimensions equal to the area of mortar of courses between bricks in a brick wall structure. The tray portion is defined by side walls 11, 12 and end walls 13, 14 formed into a continuous, rectangular, open framework adapted to be opened and closed by a sliding bottom plate a portion of which is in the form of a flat tray 15 adapted to slidably reciprocate across the rectangular bottom opening of the tray portion. The tray portion 15 of the sliding bottom plate is connected to two slide sleeves 16, 17 mounted upon or integrally or integrally moulded with the flat tray portion 15 which, when fully closed abuts a sleeve movement stop back plate 18, the sleeves 16, 17 are connected to the tray by an inner cross bar pull handle 19, the slide sleeves 16, 17 are sleeved upon, that is to say adapted to run on runners in the form of rods 20, 21 one or outer end of each rod being fixedly connected to an outer cross bar in the form of a pull handle 22 screw-mounted between the runners. This handle 22 is removable to enable the sleeves 16, 17 to be removed from the runners 20, 21 and vice versa for removal and cleaning of the flat bottom plate, sleeves 16, 17, and intergral movement stop plate 18. The inner ends of the runners are mounted upon the previously-described back plate 18. A tool-positioning front handle 23 is fixed along the outer edge of the tray portion to assist correct placement of the mortar course tool upon a brick course. Two downwardly dependent locating lugs 24, 25 also assist in locating the mortar course tool upon a brick course.

Figure 2A:
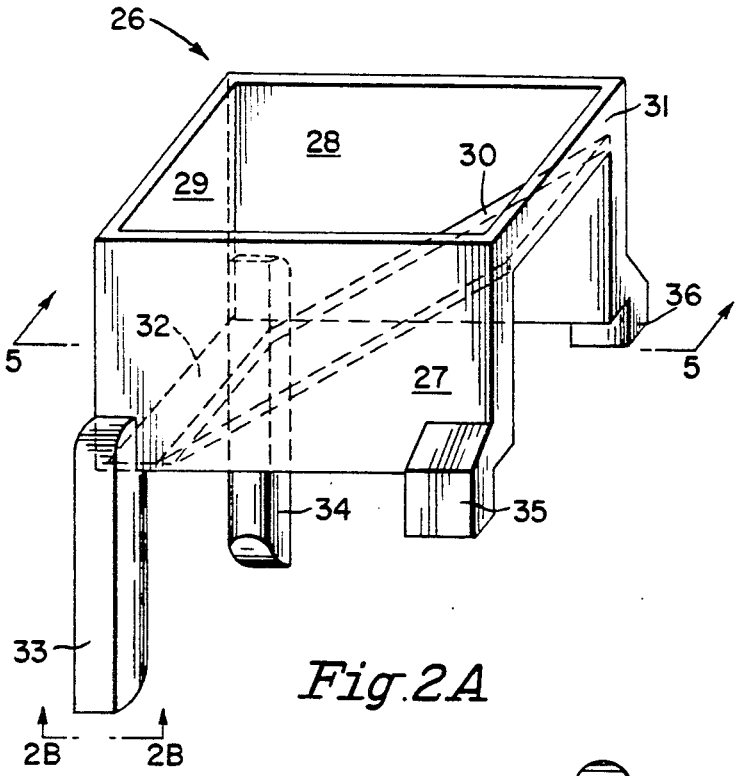
FIG. 2 is a perspective view of a mortar perpend filling tool according to the invention.
Figure 2B:
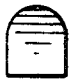

Referring to FIG. 2 of the drawings, there is shown a brick mortar perpend gap filling tool 26, constructed in accordance with the invention and which is designed to be used in conjunction with the mortar course laying tool 10 of FIG. 1. The perpend tool 26 functions as a mortar hopper for carrying mortar to a brick course line as well as for use in filling perpend gaps and is constructed in the form of an open-top box adapted to straddle a brick laid on a course and has a front wall 27, rear wall 28, one full-height side wall 29 and a bottom 30, the upper edge of which is joined to a side wall 31 of reduced height. The bottom of the hopper slopes downwardly towards a perpend, mortar-feeding, transverse slot 32, shown in broken outline only in FIG. 2, which is fixed to, or integrally moulded with the hopper portion and as shown in the encircled inset in FIG. 2, the inner face of the legs is preferably convexly curved to mould the mortar perpend. A pair of laid brick-engaging lugs 35, 36 is provided for correctly aligning the perpend tool hopper upon a wall.

Figure 3:
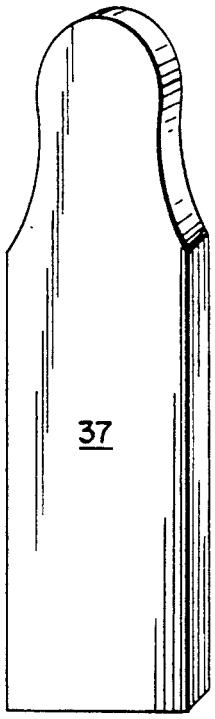
FIG. 3 is a perspective view of a mortar perpend rammer spatula for use with the tool of FIG. 2.

Referring to FIG. 3, there is provided a spatula as a mortar ramming tool 37 for manipulating mortar within the hopper and for ramming the mortar through the transverse slot 32 into a perpend gap between laid bricks.

Figure 4:
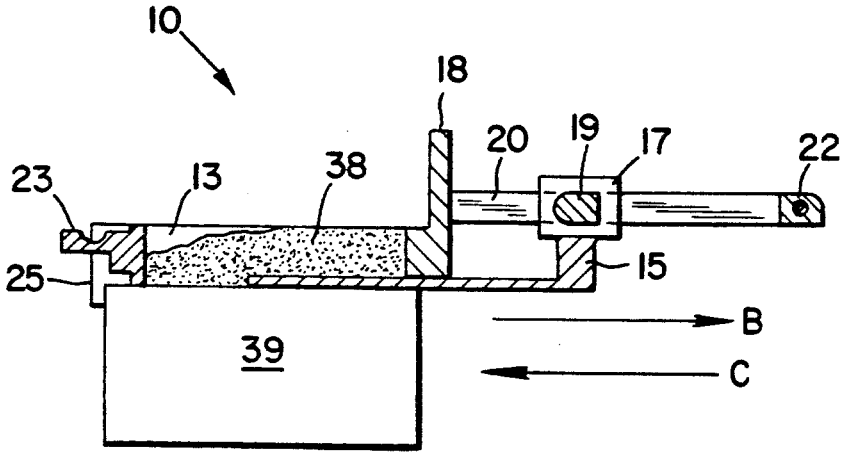
FIG. 4 is a vertical section taken along the line 4—4 of FIG. 1 in the direction of the arrows and shows the mortar course-laying tool in position on a brick wall course.

Referring to FIG. 4 which shows the mortar course laying tool 10 of FIG. 1, the sliding tray bottom is depicted in half-open position and in use. The sliding tray bottom is moved to a fully closed position with the handle 19, fully extended in the direction of the arrow C, the tool 10 is then level-filled with mortar 39 preferably using a rectangular shaped trowel (not shown) and the tool is placed over laid bricks 39 of the top course of the brick wall with the two locating lugs 24, 25, engaging one edge of the bricks. The tool is held in place by gripping the handle 23. The handle 19 is moved in the direction of the arrow B to the end of the stroke and then with the tray bottom in fully open position, the mortar wafer drops intact onto the brick course after which the mortar course tool can be removed from the brick course, refilled and the mortar laying cycle repeated as often as required.

Figure 5:
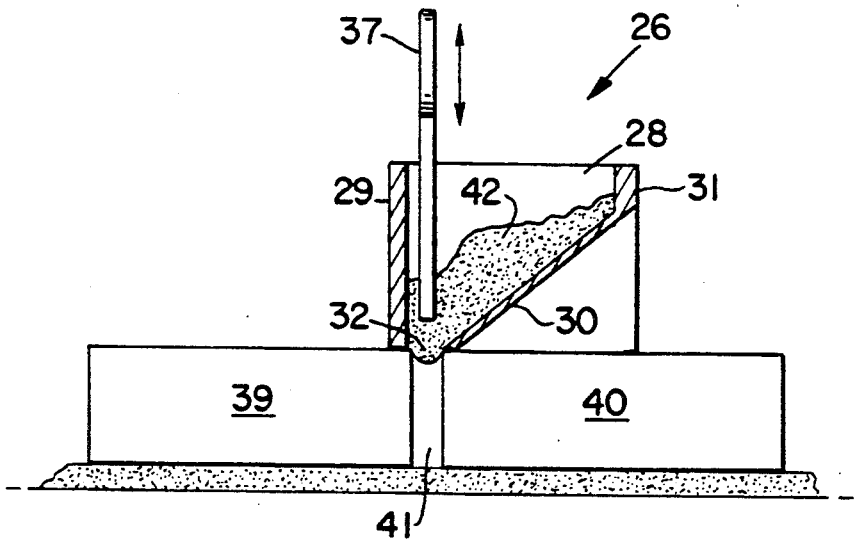
FIG. 5 is a vertical section taken along the line 5—5 of FIG. 3 in the direction of the arrows and shows the perpend filling tool in position on a brick wall course.

Referring to the mortar perpend gap filling tool 26 shown in FIG. 5, a perpend tool hopper formed by side walls 27, 28, 29, 31 and a sloping bottom 30 is filled with mortar mix and is then placed over bricks 39, 40 with two locating legs 33, 34 in alignment with a mortar perpend gap 41 in the space between adjacent bricks 39, 40 and with lugs 35, 36 engaging the edges of the brick, the mortar 42 is then manually dispensed into the mortar gap 41 by the spatula 37 (FIG. 3), via the transverse slot 32 at the bottom of the hopper. When the mortar perpend gap is full and the mortar compacted, the perpend tool is lifted off vertically, leaving compacted mortar between the bricks. The perpend tool filling of the vertical gaps (perpends) between bricks is carried out after the bricks have been laid and aligned.

The tools of the invention when used as a kit, enable more than one unskilled person at a time to work in rotation laying bricks on a brick course. When one person is filling and then carrying the mortar course tool to the brick line, another person can be filling the perpend gap with mortar and when the first person is dropping the mortar wafer upon the brick course from the mortar course tool and is laying a brick, the second person can be filling the perpend tool away from the course and then brings the perpend tool filled with mortar back to the brick course whilst the first person is laying the level-filled mortar wafer. The system of the invention is a no-waste system of laying and filling brick mortar courses.

As it is also possible to manufacture, sell and use the tools of this invention separately—although this is not recommended—I do not wish to be limited to claims to the tools only as a kit.

I claim:

1. A brick wall mortar course tool for laying a definitive quantity of mortar upon a brick course of a brick wall, the tool comprising a body with a rectangular-shaped tray frame portion formed by side walls and end walls surrounding a bottom opening of dimensions substantially equal to the area and thickness of mortar of a course laid between bricks laid along a brick wall structure, the tray frame portion being opened and closed by a flat bottom plate which is slidable across under the opening and is connected to two side sleeves connected to a movement stop back plate, the said two side sleeves being connected to each other by an inner cross-bar pull handle, each sleeve being mounted upon a runner, the outer end of each runner being connected by an outer cross bar pull handle, the flat bottom plate being movable into a full open position to drop a wafer of mortar onto a brick by moving the inner and outer cross bar pull handles towards each other and into a fully closed position by moving the pull handles away from each other.

2. The mortar course tool according to claim 1 wherein the sleeves are integrally moulded with the slidable flat bottom plate of the tray frame portion from the same thermoplastic material and the tray frame is integrally moulded with a pair of runners upon which the sleeves are adapted to be slidably reciprocated.

3. The mortar course tool according to claim 1, wherein a brick edge locating lug projects downwardly from each outer corner of the tray portion.

4. The tool according to claim 1, wherein a fixed tool-positioning handle is provided along the outer edge of the tray frame portion.

5. The tool according to claim 1, wherein the outer cross bar pull handle is removable to enable the sleeves to be removed from the runners and vice-versa for removal and cleaning of the flat bottom plate and frame with sleeves from the runners and integral movement stop plate.

6. A brick wall mortar perpend gap filling tool, the tool comprising an open-top hopper adapted to receive and carry mortar and which is formed by four walls and a floor sloping downwards towards a transverse slot adapted to be placed over a mortar perpend gap betwen bricks laid on a brick wall, means for ramming mortar into the perpend gap via the slot while the mortar course tool is in place on a brick wall course, mortar-retaining legs depending downwardly from each bottom corner of the hopper adjacent each end of the slot, the said legs being positioned to retain mortar in the perpend gap between bricks while the mortar is being placed into the gap.

7. The tool according to claim 6, wherein said means is a spatula.

8. The tool according to claim 6 wherein the mortar-retaining legs each have perpend-facing surfaces thereof convexly curved, so as to form a raked finish of external mortar face rammed into a perpend gap between bricks.

9. The tool according to claim 6 wherein a pair of tool locating lugs is provided on and off-set with respect to each bottom corner at an end of the hopper opposite to the slot and the mortar-retaining legs to correctly locate the tool on a brick laid upon a brick wall line.

10. The tool according to claim 6, wherein the mortar retaining legs are detachably and adjustably mounted on the hopper.

* * * * *